US006010392A

United States Patent [19]

Evans et al.

[11] Patent Number: 6,010,392

[45] Date of Patent: Jan. 4, 2000

[54] DIE THINNING APPARATUS

[75] Inventors: Richard J. Evans, Underhill; Philip S. Phoenix, South Burlington; David P. Vallett, Fairfax, all of Vt.

[73] Assignee: International Business Machines Corporation, Armonk, N.Y.

[21] Appl. No.: 09/024,912

[22] Filed: Feb. 17, 1998

[51] Int. Cl.[7] ..... B24B 41/06

[52] U.S. Cl. ..... 451/41; 451/386; 451/398; 451/402; 451/441

[58] Field of Search ..... 451/460, 378, 451/386, 391, 398, 402, 441, 41

[56] References Cited

U.S. PATENT DOCUMENTS

| | | | |
|---|---|---|---|
| 3,562,965 | 2/1971 | Lange | 51/283 |
| 3,665,648 | 5/1972 | Yamanaka | 51/134 |
| 3,867,797 | 2/1975 | Meier | 51/216 A |
| 3,888,053 | 6/1975 | White et al. | 51/281 SF |
| 4,020,600 | 5/1977 | Day | 51/237 R |
| 4,043,080 | 8/1977 | Maxwell | 51/33 W |
| 4,502,225 | 3/1985 | Lin | 33/18 R |
| 4,944,119 | 7/1990 | Gill, Jr. et al. | 51/215 R |
| 5,089,081 | 2/1992 | Bedzyk | 156/556 |
| 5,309,628 | 5/1994 | Fukuchi et al. | 29/759 |
| 5,433,378 | 7/1995 | Orlandi | 236/122 |
| 5,468,177 | 11/1995 | Kindler et al. | 451/364 |
| 5,584,751 | 12/1996 | Kobayashi et al. | 451/288 |
| 5,681,215 | 10/1997 | Sherwood et al. | 451/388 |

OTHER PUBLICATIONS

IBM Technical Disclosure Bulletin, vol. 31, No. 04, Sep., 1988, "Multi–Prupose Lapping/Polishing Fixture for Microanalysis".

*Primary Examiner*—Joseph J. Hail, III
*Assistant Examiner*—William Hong
*Attorney, Agent, or Firm*—Howard J. Walter, Jr.

[57] ABSTRACT

A fixture for holding a semiconductor die against an abrasive media for the purpose of thinning the die is described. The fixture provides means for aligning the back of the die to a reference plane that is coplanar with the plane of the abrasive and is in contact with the abrasive media during the thinning process.

12 Claims, 3 Drawing Sheets

DIE THINNING APPARATUS

FIELD OF THE INVENTION

The present invention relates to the field of polishing a workpiece; more specifically, it relates to an apparatus and method for thinning a semiconductor die from the backside.

BACKGROUND OF THE INVENTION

As semiconductor dies are becoming very densely populated with active devices with a proportional increase in the number and density of interconnect layers, it becomes more difficult to perform diagnostic and failure analysis from the top or active side of the die because the density of the interconnects block optical and other signals. Therefore, backside analysis techniques are being developed, such as optical emission spectrophotometry, infrared analysis, focused ion beam milling and electron beam analysis to overcome the problem presented by the density of interconnect wiring. However many of these techniques require that most of the bottom or non-active side of the die be removed in a process called thinning. The resultant die thickness must be of the order of 15 to 100 microns, and uniform over chip sizes as large as 25 by 25 millimeters square.

Turning to the prior art, FIG. 1 shows a known prior art fixture comprising a top plate 1, connected to a bottom plate 2 by pins 3. Attached to bottom plate 2 are hard reference feet 4 numbering at least three and as many as six, dispersed in a ring along the periphery of the fixture and generally made from tungsten carbide which define a reference plane. A die plate 2A is axially located to which die 60 can be attached. Tapered rings 5 are used to set the exposed surface of the die into the reference plane defined by the reference feet. Spring 7 is used in combination with locking ring 6 to maintain the alignment of the sample. Knob 8 is used to gradually feed the workpiece into the abrasive media.

IBM technical disclosure bulletin Vol. 31, No. 4, pp. 402 to 404, describes a lapping/polishing fixture for microanalysis that utilizes micrometers to align a sample to a plane formed from three reference feet attached to the micrometers. The feet are made of nylon and are in contact with the polishing wheel during operation in order to maintain the planarity of the sample. The reference feet will quickly wear, destroying the reference plane when hard materials such as silicon are lapped.

U.S. Pat. No. 5,468,177 to Kindler et al. describes a method and apparatus for lapping air bearing surfaces on disk sliders. A compliant pad is used to press the workpiece into the abrasive media, while reference feet in contact with the abrasive media establish a reference plane. Because the workpiece is not rigidly held, corner rounding of large workpieces will occur.

A common feature of prior art fixtures is the requirement that the reference feet be in contact with the abrasive media at all times. When the reference feet are made of hard material, wear of the abrasive pad occurs and of the reference feet occurs over time. When the reference feet are made of soft material, the reference plane is quickly lost. In both cases, the result is a changing reference plane during the thinning process.

SUMMARY OF THE INVENTION

It is an object of the present invention to provide a fixture for holding a semiconductor die against an abrasive media such as a polishing wheel, for the purpose of thinning the die by removal of material from the back or non-active side of the die. The fixture provides means for aligning the back of the die to a reference plane that is coplanar with the plane of the abrasive pad to ensure very precise and uniform material removal. Further the fixture allows only the semiconductor die to be in contact with the abrasive media during the thinning process. It is desirable that said fixture be mountable to an automatic polishing unit wherein rotation speed and pressure between the die and abrasive media can be controlled.

It is a further object of the present invention to provide a process for thinning semiconductor dies.

BRIEF DESCRIPTION OF DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
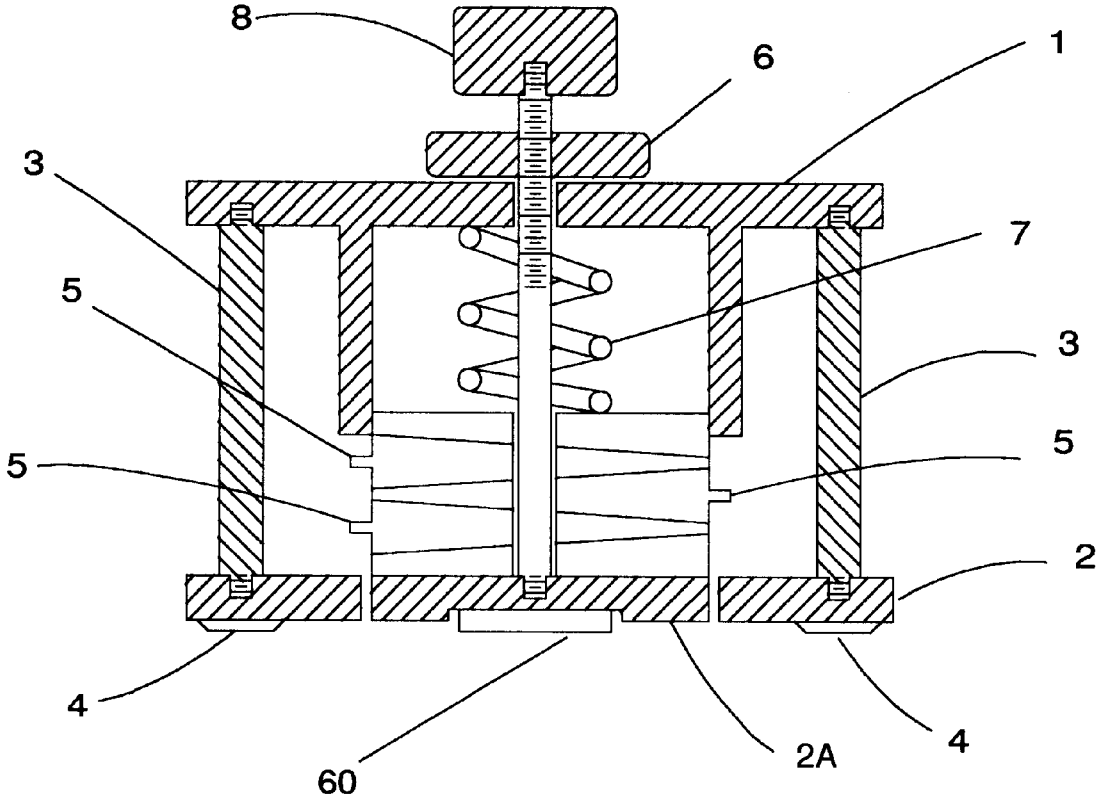
FIG. 1 Prior Art
FIG. 1 is a sectional view of a prior art polishing fixture.
Figure 2:
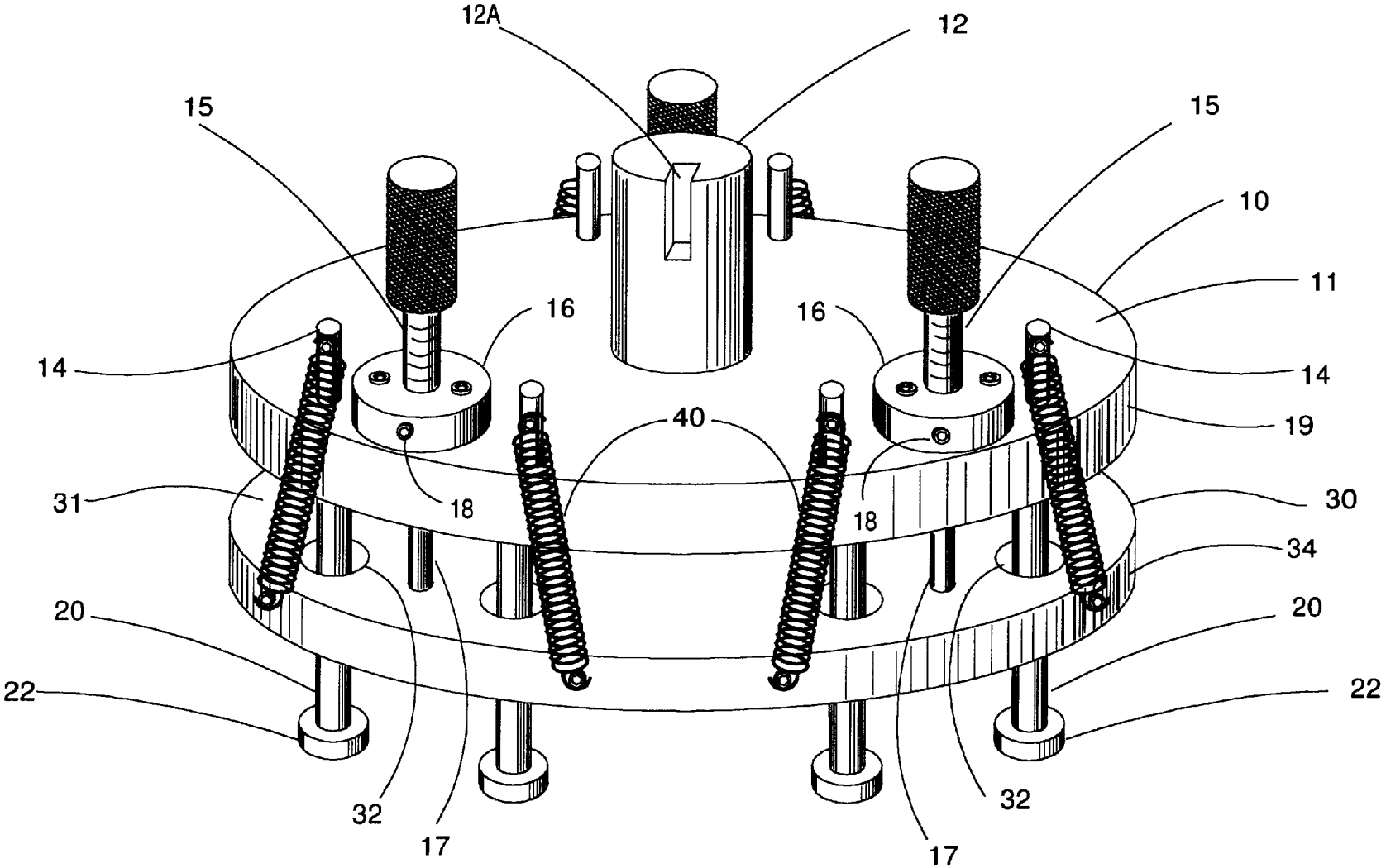
FIG. 2 is a perspective view of the polishing fixture of the present invention.

Referring to FIG. 2, there is shown a perspective view of a thinning fixture which includes a backing plate 10 to the underside of which are three pairs of fixed posts 20 having reference feet 22. Posts 20 extend through bottom backing plate 30 through openings 32. Affixed to the top surface 11 of backing plate 10 by holders 16 are three adjustment micrometers assemblies 15 having pistons 17. The length of exposed piston 17 is adjusted by micrometer assembly 15. Holders 16 have locking screws 18 for stopping the micrometers assembly from moving piston 17. Alternatively the micrometer assemblies may be replaced with simple fine thread screws. Pistons 17 extend through backing plate 10 to impinge upon the top surface 31 of die plate 30. One micrometer assembly 15 is disposed between each pair of fixed posts 20. Die plate 30 is kept in contact with pistons 17 by means of tension springs 40. Tension springs 40 have one end fixed to edge 34 of die plate 30 and the opposite end to posts 14. Posts 14 are mounted to the top surface 11 of backing plate 10 and disposed in pairs on either side of micrometer assembly 15. Alternatively the opposite end the tension springs may be mounted to edge 19 of backing plate 10. The micrometer assemblies are disposed in a triangular arrangement so it is readily apparent the plane of die plate 30 relative to the plane of backing plate 10 is determined by the relative exposed lengths of pistons 17. A mounting hub is axially mounted to backing plate 10 for attaching the fixture to a tool for rotating and pressing the fixture against a polishing or grinding media.

Figure 3:
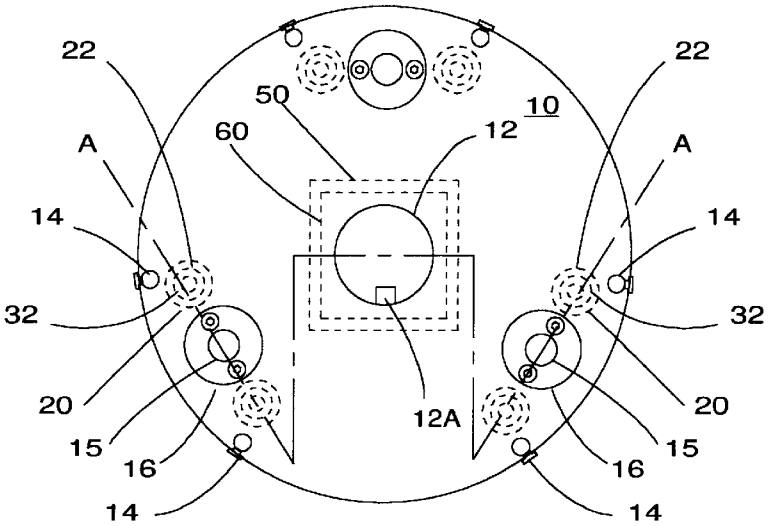
FIG. 3 is a top view of the polishing fixture of the invention.

The disposition of the major components are shown in FIG. 3. Three micrometer assemblies 15 are radially disposed along the outer periphery of backing plate 10. Disposed on either side of micrometer assemblies 15 are fixed posts 20 and attached reference feet 22. From this view it is clear that the mounting hub is located at the center of the fixture and the die 60 would be mounted to die holder 50, which must be at least as thick and preferably thicker than the reference feet 22, directly under hub 12. It is possible to thin the die while it is still mounted in its package by use of a module socket as a holder or by attaching the module directly to the bottom surface 33 of die plate 30, provide the package is thick enough. Black wax is a suitable adhesive for attaching the die.

Figure 4:
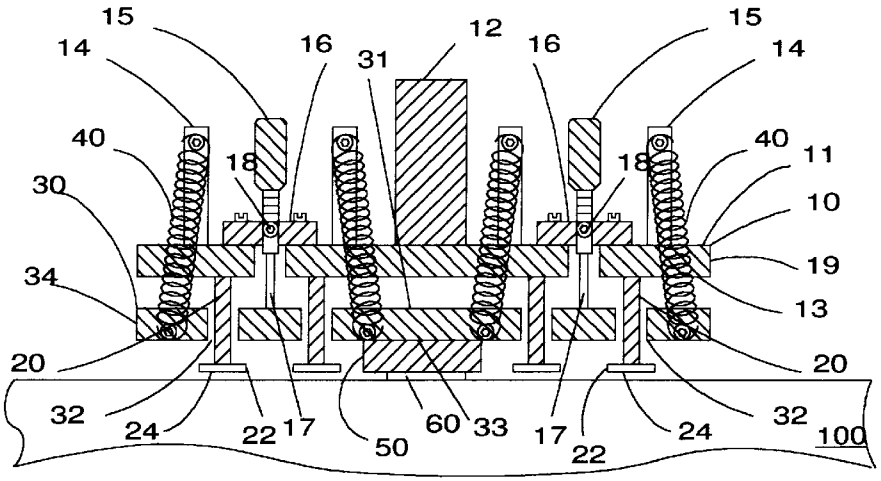
FIG. 4 is a sectional view through AA of FIG. 3 of the polishing fixture of the invention.

FIG. 4 is a sectional view through line AA of FIG. 3. The fixture is shown with a die 60 in contact with a abrasive media 100. Typically abrasive media 100 is a rotating wheel having an abrasive paper fixed to it or a resilient pad for receiving an abrasive slurry. It can be seen that the bottom surface 24 of reference feet 22 are not in contact with abrasive media 100.

Before the fixture can be used it must be prepared. Feet 22 are made of a soft material such as hard plastic, mild steel, aluminum or the like. It is important that the feet be easily ground flat in order to establish a reference plane. To prepare the fixture the micrometers are adjusted so no portion of die holder 50 extends below all reference feet 22. The fixture is then applied to a abrasive media 100 contacting all feet 22 simultaneously. More precise thinning of the die 60 is obtainable if the same abrasive media tool is used to flatten the reference feet is also used to thin the die. The reference feet 22 are then ground down until the bottom surface 24 of each foot 22 is flat and all are coplanar. Thus the reference feet 22 provide a reference plane in which the die 60 will be aligned. Various means may be used to accomplish this alignment. One method being to place the reference feet 22 on an inverted stage microscope and adjust the micrometers until all comers of the die are in focus. Another method is to place a drop of water on the die and then place a glass plate across the reference feet 22, forming a bubble of water between the die and the glass plate. The micrometers 15 are then adjusted until the edges of the bubble are symmetrical and the bubble is centered on the die.

Figure 5:
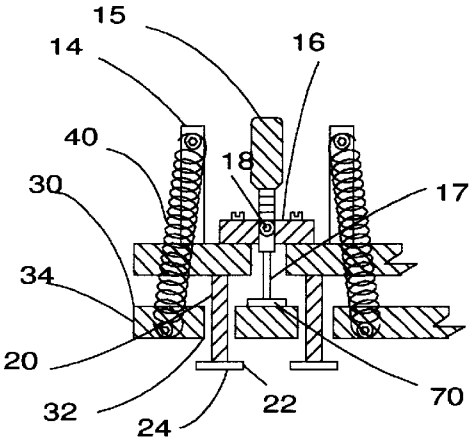
FIG. 5 is a portion of the sectional view of FIG. 4 of the polishing fixture of the invention showing an alternative means for setting the thinned die thickness.

Prior to thinning the die the reference feet are retracted by turning each micrometer by the same amount. The fixture is then mounted in the automatic polishing unit. To improve accuracy the fixture is provided with means, notch 12A, to position the fixture on the shaft of the automatic polishing tool such as a Buhler Automet a in the same position as was used when the reference feet were flattened. As the die thins, the reference feet will eventually come in contact with abrasive media 100. This signals the endpoint of the operation, or the thinning may be terminated just before the reference feet 22 contact the abrasive media 100. FIG. 5 shows an alternative method of retracting the reference feet. Shims 70 are placed between pistons 17 and the top surface 31 of die plate 30 to control the thickness of the die to be removed without adjusting micrometer assemblies 15, thus, adjusting the amount of displacement of the die from the reference plane.

The description of the embodiments of the present invention is given above for the understanding of the present invention. It will be understood that the invention is not limited to the particular embodiments described herein, but is capable of various modifications, rearrangements and substitutions will now become apparent to those skilled in the art without departing from the scope of the invention. Therefore it is intended that the following claims cover all such modifications and changes as fall within the true spirit and scope of the invention.

What is claimed is:

1. A fixture for holding a flat workpiece to facilitate the thinning or removal of a substantial portion of the original thickness of the workpiece, comprising:

a polish stop having at least three points in a common reference plane wherein said reference plane is parallel to a polishing surface, and an adjustable workpiece holder for positioning a surface of the workpiece parallel to said reference plane of said polish stop and displaced therefrom in a direction normal to said reference plane, said adjustable workpiece holder comprising:

screw means attached to an upper plate and bearing on a lower plate to which the workpiece is mounted; and tension means for holding said lower plate in contact with said screw means.

2. The fixture of claim 1, wherein said polishing stop comprises a plurality of posts having feet attached to said upper plate, and extending below said lower plate.

3. The fixture of claim 2, further comprising a hub mounted on said top plate for mounting said fixture into the shaft of an automatic polishing tool.

4. The fixture of claim 1, wherein said screw means comprises micrometers and said tension means comprises coil springs.

5. The fixture of claim 2, wherein said feet are comprised of material selected from the group consisting of plastic, steel, and aluminum.

6. The fixture of claim 1, wherein the amount of displacement of the workpiece from said reference plane is determined by shims inserted between said screw means and said lower plate.

7. A fixture for removing a substantial portion of the backside of a die comprising:

a backing plate;

a die plate under said backing plate for attaching the die;

at least three reference feet fixedly attached to said backing plate and extending below said die plate;

at least three screw means having a first end fixedly attached to said backing plate and a second end thrusting upon said die plate for adjusting the distance and parallelism between said reference feet and the backside of the die; and tension means for holding said die plate in contact with the second end of said screw means.

8. The fixture of claim 7, wherein said screw means comprises micrometers.

9. The fixture of claim 7, wherein said tension means comprises coil springs.

10. The fixture of claim 7, wherein said reference feet are comprised of material selected from the group consisting of plastic, steel, and aluminum.

11. The fixture of claim 7 further comprising shims inserted between said second end of said screw means and said die plate for setting the normal displacement of the backside of the die from said reference plane.

12. The fixture of claim 7, further comprising an axial hub attached to the upper surface of said backing plate for attaching said fixture to an automatic polishing tool.

* * * * *